United States Patent [19]

Kastening et al.

[11] 4,385,969

[45] May 31, 1983

[54] METHOD OF REGENERATING AN AMMONIACAL ETCHING SOLUTION

[75] Inventors: Bertel Kastening, Hamburg; Wolfgang Faul; Leander Fürst, both of Jülich; Walter Holzer, Meersburg, all of Fed. Rep. of Germany

[73] Assignees: Kernforschungsanlage Jülich Gesellaschaft mit beschränkter Haftung, Jülich; Elo-Chem Atztechnik GmbH, Meersburg, both of Fed. Rep. of Germany

[21] Appl. No.: 287,492

[22] Filed: Jul. 27, 1981

[30] Foreign Application Priority Data

Aug. 21, 1980 [DE] Fed. Rep. of Germany ..... 3031567

[51] Int. Cl.[3] ..... C25C 1/12; C25C 1/00; C25C 1/16

[52] U.S. Cl. ..... 204/105 R; 204/106; 204/107; 204/108; 204/119; 210/763

[58] Field of Search ..... 204/130, 129.75, 106–108, 204/119, 105 R; 210/763, 765

[56] References Cited

U.S. PATENT DOCUMENTS 3,017,347 1/1962 Kratz ..... 210/763

3,944,487 3/1976 Davis et al. ..... 210/763

4,269,678 5/1981 Faul et al. ..... 204/130

4,280,887 7/1981 Konstantouros ..... 204/130

*Primary Examiner*—R. L. Andrews

*Attorney, Agent, or Firm*—Frishauf, Holtz, Goodman & Woodward

[57] ABSTRACT

In addition to catalyzing the reoxidization of spent alkaline etching agent, the suspension of activated carbon powder in the etching solution also increases the speed of etching when the etching solution is recirculated in the etching of printed circuit boards. The ammonium sulfate etching solution is set to a pH of about 9 by the addition of ammonia gas. In the recirculation of the etching solution, a part of the solution can be freed by filtration from suspended carbon particles and passed through the cathode and anode chambers of an electrolysis cell for the recovery of the etched metal by deposition on the cathode. The activated carbon powder for this purpose is calcined before use, at a temperature of between 900° and 1200° C. in vacuum or in an atmosphere that is inert, reducing, or only slightly oxidizing as in the case of an atmosphere containing carbon dioxide, water vapor or both, in a concentration that does not appreciably oxidize the carbon particles.

6 Claims, 4 Drawing Figures

METHOD OF REGENERATING AN AMMONIACAL ETCHING SOLUTION

The present invention concerns a method of regenerating an ammoniacal etching solution to which oxygen is supplied for reoxidizing the spent etching agent in the solution.

Alkaline etching agents are used for etching metallic objects, particularly for the manufacture of circuit plates or "boards" which are also known as "printed circuits". These etching agents are used especially when the circuit boards to be etched have metallic portions as protective coating that are not resistant to acid etchants, for example metal paths which in part expose lead, tin or nickel.

Reoxidation of the alkaline etching solution after its use for etching away metal is carried out with addition of ammonia gas and/or ammonium chloride in the presence of oxygen or air. In this process, not only are the added chemicals used up, but waste solutions are produced that cannot be discarded without a previous detoxification treatment. See, for example, H. Bruch et al, "Leiterplatten", Eugen G. Leutze-Verlag, Saulgau/-Württemberg, 1978.

In the reoxidation of the alkaline etching solution by the blowing in of oxygen, a more rapid regeneration is indeed obtained with alkaline etchants than with acid etchants, but the reaction rate still remains slower than that which can be obtained by the use of chemical oxidants.

THE INVENTION

It is an object of this invention to provide a method of regenerating alkaline etching solutions which produces no residual solutions having toxic effect and which provides a rapid reoxidation of the etching solution. In this connection it is noted that a method is known from German Pat. No. 27 14 075, to which corresponds U.S. patent application Ser. No. 214,744 by which suspended activated carbon particles are provided in an aqueous solution as a catalyst for the oxidation of noxious ions, such as nitrite, cyanide or sulfite for detoxification. The present invention takes this known effect of the activated carbon particles as a starting point.

Briefly, activated carbon particles which have been calcined at a temperature of between 900° and 1200° C. in vacuum or in an atmosphere that is inert or reducing or contains carbon dioxide, water vapor or both, are suspended in the etching solution before or during the supply of oxygen to the solution for oxidizing the spent etching agent. The activated carbon particles suspended in the solution act as catalyst in the presence of oxygen for the reoxidation of the etching agent that has been reduced by the etching of metal. It has unexpectedly been found that after the suspension in the solution of the activated carbon powder particles of the kind above mentioned, and after their effect as a catalyst has been exerted, the etching speed of the solution is substantially increased upon circulation of the solution.

The activated carbon powder particles that have this remarkable effect in the etching solution are, as already mentioned, treated by calcination in vacuum in an inert or reducing atmosphere or one containing $CO_2$ or water vapor, or both, at a temperature of between 900° and 1200° C. In the calcination in the last-mentioned kind of atmosphere the content of $CO_2$ and water vapor is so adjusted that during the treatment, only a small consumption or disintegration of the active carbon powder results. It has been found favorable to calcine the activated carbon particles in the above-described manner for more than an hour.

Providing a concentration of the activated carbon particles in the etching solution between 5 and 25% by weight has been found desirable, and preferably between 10 and 12% by weight, because in this manner a viscosity suitable for circulation of the etching solution and for spraying it is obtained.

It is useful to separate some of the solution, on a continuous basis, from the suspended carbon, and to feed it through the cathode of an electrolysis cell for precipitation of the metal ions dissolved in the etching solution. The portion of the etching solution so diverted and treated, and the electrolysis current, are so determined that the resulting metal concentration thus resulting from the precipitation of the metal ions at the cathode and the return of the electrolyzed solution to the system is sufficient for an optimum etching speed. The portion of the etching solution fed through the electrolysis cell is simply guided back to the etching solution circulation path after it has passed through the cathode chamber of the cell.

DRAWINGS

The invention is further described by way of example with reference to the annexed drawings, in which.

DETAILED DESCRIPTION OF THE INVENTION

In experimental data graphs, the effects obtained with the addition of activated carbon powder particles to the etching solution are compared with etching solutions that contain no activated carbon powder particles, in order to show the effect of the suspended particles. The suspended activated carbon particles in these cases had previously been calcined in vacuum or in a reducing atmosphere at 1000° C. for one hour. Comparable results were also obtained with activated carbon powders that had been calcined at temperatures above 900° C. in inert atmospheres containing $CO_2$ or water vapor. In these cases, the $CO_2$ or water vapor content of the atmosphere was so determined that the activated carbon powder was only slightly oxidized.

Figure 1:
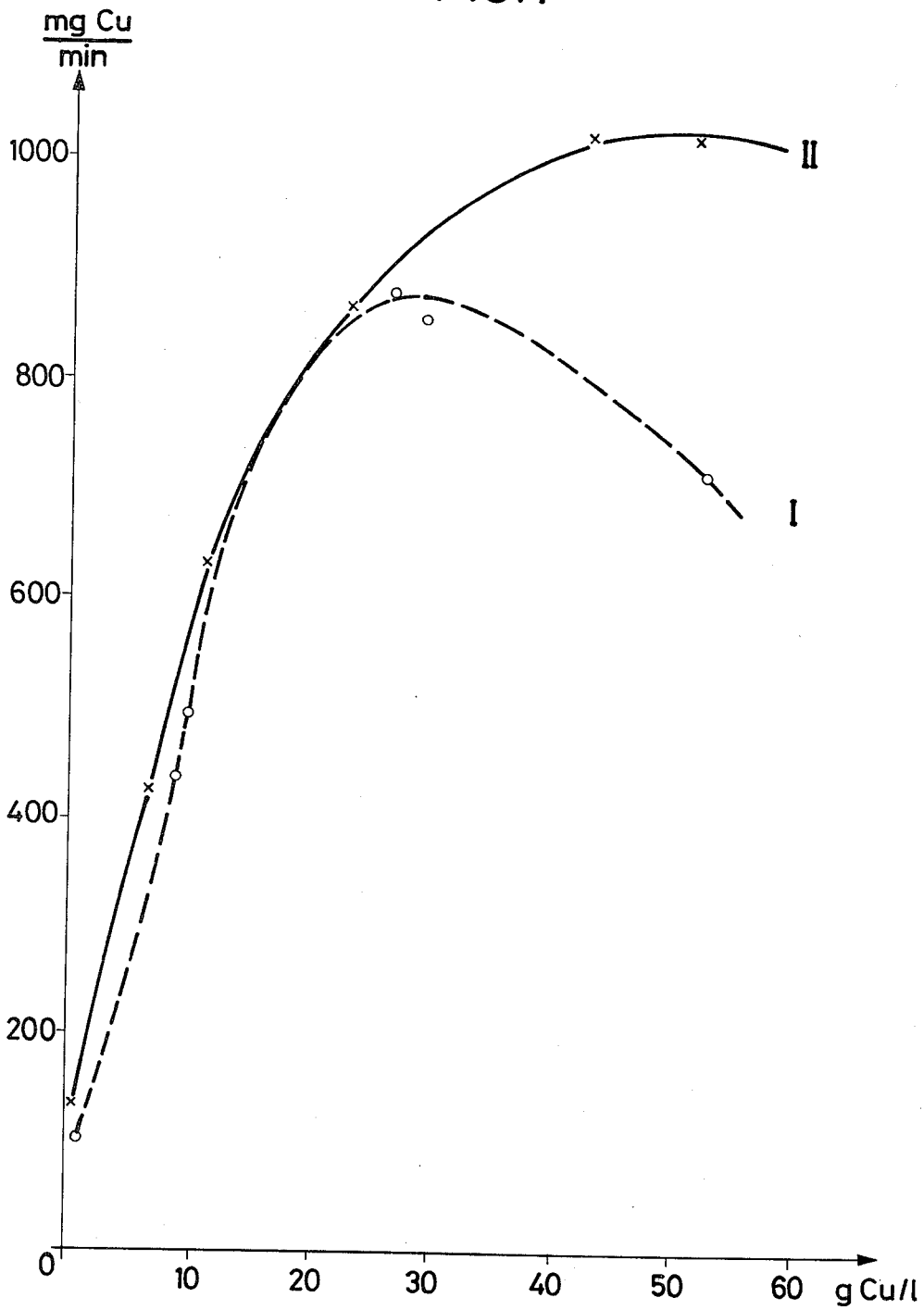
FIG. 1 is a graphical representation of the dependence of the etching speed on the copper content of an etching solution containing ammonium sulfate used for the etching of copper, both without (Curve I) and with (Curve II) activated carbon powder particles suspended in the etching solution.
Figure 2:
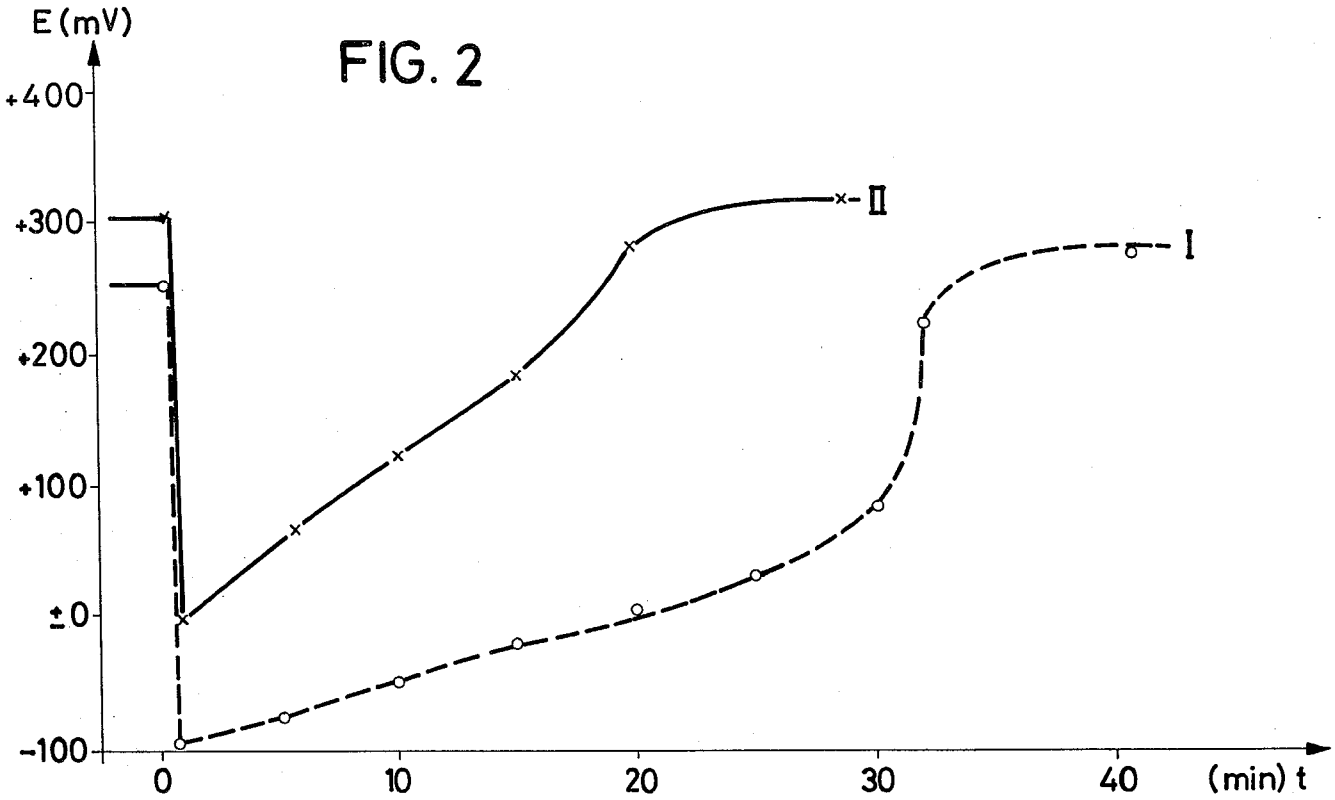
FIG. 2 is a graphical representation of the time course of the potential of an etching solution for the etching of copper, both without (Curve I) and with (Curve II) suspended activated carbon particles during reoxidation in the presence of oxygen.
Figure 3:
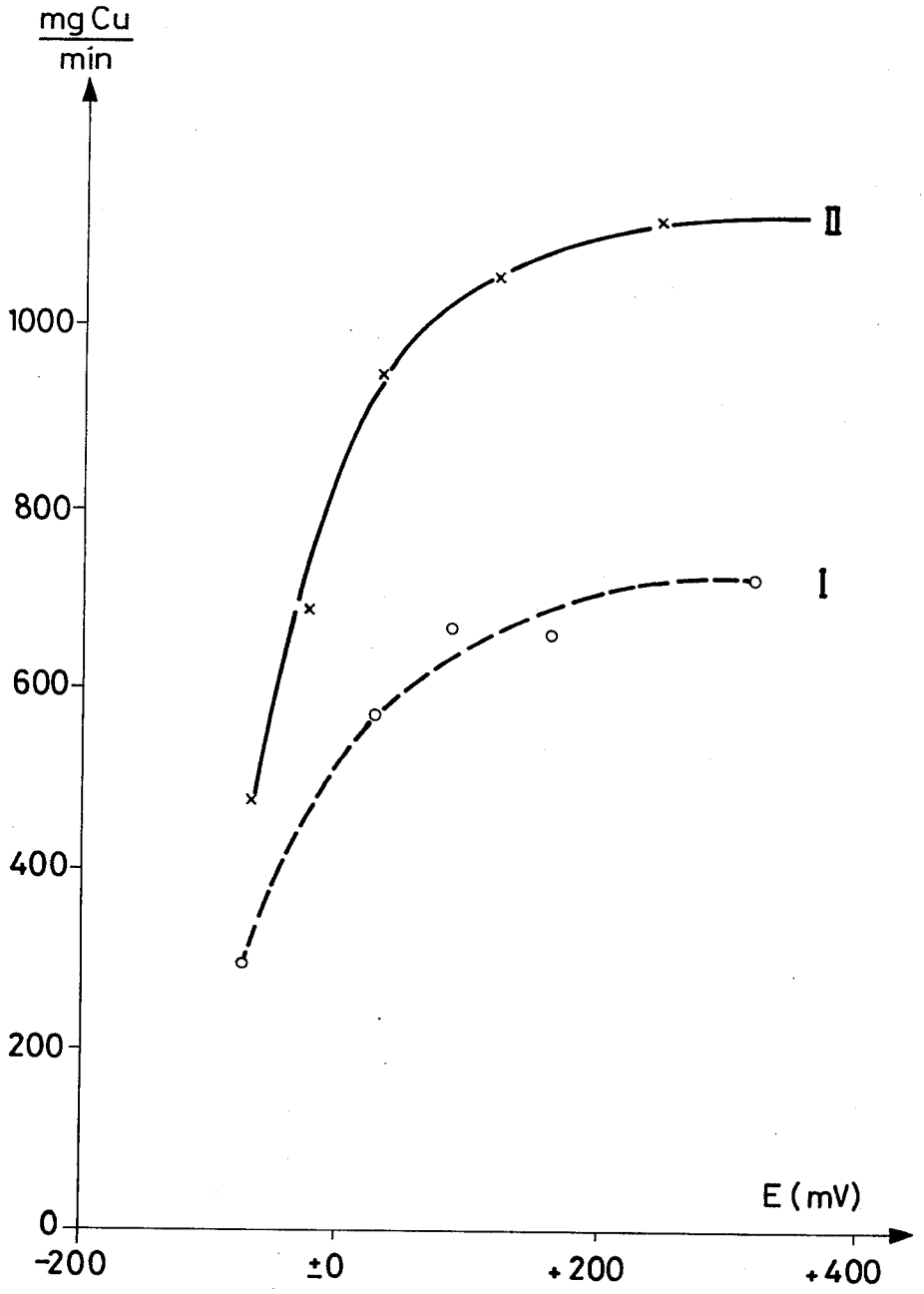
FIG. 3 is a graph representing the dependence of the etching speed of an etching solution for copper upon the potential of the etching solution, both without (Curve I) and with (Curve II) suspended activated carbon particles.

All the diagrams provided in FIGS. 1-3 show improvements in the etching of copper obtained with the use of activated carbon powder. An ammonium-sulfate solution with a content of 150 g of ammonium sulfate per liter was used as the etching solution, which was set at a pH value of 9 by the addition of gaseous ammonia.

For measuring the etching velocity in dependence upon copper content in the solution, different amounts of copper content were provided as copper sulfate and the dissolution velocity of a copper plate sprayed in air with etching solution was measured. The obtained etching velocities with etching solutions without activated carbon powder particles are shown in curve I in FIG. 1, while the etching velocities with 12 percent by weight of suspended activated carbon particles is reproduced in curve II. From the course of the curves I and II, it is evident that solutions with a copper content of about 20 g of copper per liter have a substantially higher etching speed with the addition of activated carbon powder than etching solutions without activated carbon powder.

In particular, it is advantageous that the maximum of the etching speed for etching solutions with carbon powder particles compared to etching solutions without carbon powder particles is shifted towards higher copper contents in the solution.

In order to determine the influence of the activated carbon powder on the reoxidization of an etching solution, the following examples were carried out:

EXAMPLE 1

A solution of 150 g of ammonium sulfate and 30 g of copper per liter was set at a pH value of 9 by the addition of gaseous ammonia. The solution was sprayed in air by means of a nozzle for oxidation, was collected in an upwardly open solvent basin and was recirculated continuously. The pressure above atmospheric in the solution ahead of the nozzle was 0.7 bar. The potential of the solution was measured by a platinum rod with reference to mercury/mercury oxide reference electrode. 1.5 liters of this solution were put into circulation and were thereby warmed up to 50° C.

40 g of copper powder were then dissolved in the solution which resulted in a negative shift of the potential in the solution by 330 millivolts. The time course of the potential in the solution is reproduced in curve I of FIG. 2. The starting potential in the solution was about 80 percent recovered after 32 minutes.

Under the same conditions, an etching solution of same composition was measured in which, in addition, 12 percent by weight of activated carbon powder was suspended. After the addition of 40 g of copper powder in the 1.5 liters of the solution that were in circulation, the potential of the solution sank by 310 millivolts. After less than 20 minutes the initial potential in the etching solution had recovered to the 80 percent level. The course of the potential of the solution is reproduced in curve II of FIG. 2.

EXAMPLE 2

At a temperature of 48° C. and a pH value of 9.2, 1½ liters of an aqueous solution containing 150 g of ammonium sulfate and 35 g of copper (as sulfate) per liter were sprayed in air by means of a nozzle at a pressure of 1.5 bar and were put into circulation. The etching speed in the etching of copper was measured as a function of the potential of the solution as measured against a mercury/mercury oxide reference electrode. The dependence of the etching speed on the potential of the solution is represented in FIG. 3. Curve I in FIG. 3 shows the dependence of the etching speed upon the potential of an etching solution without activated carbon powder particles.

If 12 percent by weight of activated carbon powder is added to an etching solution of the same composition, then for the same potential of the solution, a much higher etching speed is obtained—see curve II, in FIG. 3.

In the presence of activated carbon powder in the etching solution, accordingly, not only the reoxidization of the etching solution is accelerated, but also in addition higher etching speeds were obtained.

Figure 4:
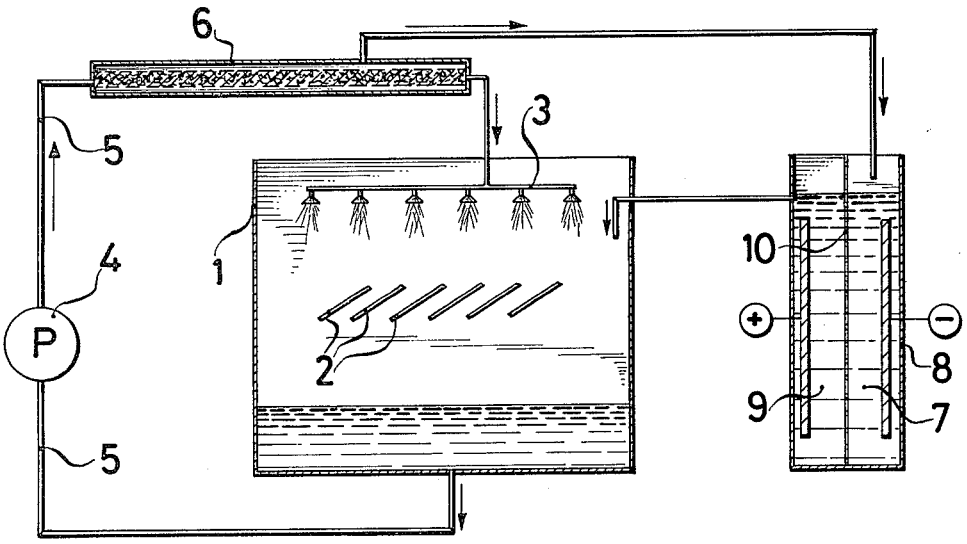
FIG. 4 is a schematic diagram of an etching apparatus including an electrolysis cell.

The following examples 3 and 4 were carried out in an etching installation schematically represented in FIG. 4. This etching installation consists of an etching chamber 1 in which the objects 2 which are to be etched are sprayed with ammoniacal etching solution by means of a spraying device 3. The etching solution is fed by a solvent pump 4 from the bottom of the etching chamber 1 into circulation through a pipe 5 connected with the spraying device 3. A section of the pipe 5 consists of a filter 6 through which the etching solution can pass which holds back the activated carbon particles suspended in the etching solution. The portion of the etching solution passing through the filter 6 and containing no particles is fed to the cathode chamber 7 of an electrolysis cell 8 and after cathodic deposition of the etched metal is fed further through the anode space of the electrolysis cell, which is separated from the cathode chamber by a diaphragm 10, back into circulation, in the illustrated example into the etching chamber 1.

EXAMPLE 3

Fifteen liters of etching solution which contained 150 g of ammonium sulfate and 50 g of copper per liter as well as activated carbon powder in the amount of 10 percent by weight were put into circulation in the etching installation illustrated in FIG. 4 and were sprayed in air by means of the spraying device equipped with nozzles at a pressure of 0.8 bar above atmospheric pressure. The etching solution was warmed up to 50° C. and was set at a pH value of 9 by the addition of ammonia gas. Copper plates were etched. The etching speed was about 2.6 g of copper per minute. About 20 milliliters per minute of the solution were continuously put through a diaphragm which was set into the pipe line as a filter and then thus freed of activated carbon powder, were separated from the circulating system and led into the cathode chamber of the electrolysis cell. Copper was precipitated out of the etching solution at a stainless steel cathode with 30 amperes dc, corresponding to a current density of 5 amperes per $dm^2$. The etching solution with reduced copper content then penetrated through the diaphragm separating the cathode and anode chambers of the electrolysis cell, into the anode chamber of the cell. A plastic material network resistant to the etching solution was used as the diaphragm. The etching solution was led out of the anode chamber back into the circulation path of the etching solution containing the suspended activated carbon powder particles.

In the course of 8 hours of operation, 306 g of copper were discontinuously removed, corresponding to an average amount of 0.64 g of copper per minute. During this time, 278 g of copper were deposited at the cathode, corresponding to a copper quantity of 0.62 g per minute. This quantity of deposited copper corresponds to 98 percent of the theoretically possible quantity of 284.5 g that could be deposited, with reference to the current caused to flow through the electrolysis cell. With an electrode spacing of 2 cm in the electrolysis cell, the cell voltage was 2.3 volts.

EXAMPLE 4

With an ammonical etching solution brass was etched in the installation illustrated in FIG. 4. A part of the aqueous solution that contained 150 g of ammonium sulfate, 21 g of copper and 24 g of zinc (both as sulfates) per liter was introduced into the cathode chamber of the electrolysis cell equipped with a stainless steel cathode. At a pH value of 9.5, a solution temperature of 20° C. and a current density of 5 amperes per $dm^2$, an alloy of 66 percent copper and 34 percent zinc was deposited out at the stainless steel cathode in the electrolysis cell. The current yield for the metal deposition was 92 percent.

For reoxidization, activated carbon powder particles were suspended in the etching solution in the same manner as in the previously described examples and the etching solution was sprayed in air for contact with oxygen.

Although the invention has been described with reference to particular examples, it will be understood that variations and modifications are possible within the inventive concept.

We claim:

1. Method of regenerating an ammoniacal etching solution to which oxygen is supplied for reoxidation of the etching agent contained in said solution, comprising the steps of:

calcining activated carbon particles at a temperature between 900° C. and 1200° C. in vacuum or in an atmosphere which is inert, or reducing or contains $CO_2$ or water vapor or both;

allowing said carbon particles to cool in vacuum or said atmosphere, and suspending said particles in said etching solution before or while oxygen is supplied to said solution for reoxidation of spent etching agent therein.

2. Method as defined in claim 1, in which the calcination step is continued for more than one hour.

3. A method as defined in claim 1, in which the step of suspending said particles is carried out so as to provide a concentration of said activated carbon particles in said solution, which is between 5 and 25% by weight.

4. A method as defined in claim 3, in which the step of suspending said carbon particles in said etching solution is carried out so as to produce a concentration of said carbon particles in said solution between 10 and 12% by weight.

5. A method as defined in claim 1, 2, 3 or 4, applied to the regeneration of an ammoniacal etching solution which has been used for the etching of metal which it is desired to recover from the solution, and in which method a part of said etching solution is separated from carbon previously suspended therein and is thereafter fed through the cathode chamber of an electrolysis cell for recovery of metal.

6. A method as defined in claim 5, in which the portion of said solution which contains said activated carbon particles in suspension is circulated for further cycles of etching after regeneration, and in which said part of said solution from which the particles of carbon are separated, after passing through said electrolysis cell, is reinserted into the circulation path of the remainder of said etching solution.

* * * * *